US008956514B2

(12) United States Patent
Hocevar et al.

(10) Patent No.: US 8,956,514 B2
(45) Date of Patent: Feb. 17, 2015

(54) RACK FOR COATING COMPONENTS

(71) Applicant: Kohler Co., Kohler, WI (US)

(72) Inventors: John Michael Hocevar, Sheboygan, WI (US); William J. Hanmann, Jr., New Holstein, WI (US)

(73) Assignee: Kohler Co., Kohler, WI (US)

( * ) Notice: Subject to any disclaimer, the term of this patent is extended or adjusted under 35 U.S.C. 154(b) by 54 days.

(21) Appl. No.: 13/672,868

(22) Filed: Nov. 9, 2012

(65) Prior Publication Data

US 2014/0131295 A1 May 15, 2014

(51) Int. Cl.
*C25D 17/00* (2006.01)
*C25D 17/08* (2006.01)
*C25D 13/22* (2006.01)

(52) U.S. Cl.
CPC ..... *C25D 17/08* (2013.01); *C25D 13/22* (2013.01)
USPC ..... 204/297.06

(58) Field of Classification Search
CPC ..... C25D 17/08; C25D 17/06; C25D 17/00; C25D 13/22; B05B 13/0285; A47G 25/743; A47G 25/1442; A47G 25/1457; A47F 5/01; A47F 5/0006
USPC ..... 211/119, 113, 118, 89.01, 124, 181.1, 211/106.01; 204/297.01, 297.06, 297.09, 204/297.1, 297.14; 248/302, 215; 118/500, 118/620, 622, 503; 174/68.1, 69.3, 72 A, 174/72 C, 70 C, 95, 72 R; 269/903; 254/134.3 CL, 134.3 PA
See application file for complete search history.

(56) References Cited

U.S. PATENT DOCUMENTS

| | | | | | |
|---|---|---|---|---|---|
| 1,010,648 | A | * | 12/1911 | Leffel | 204/297.13 |
| 1,715,411 | A | * | 6/1929 | Di Cesare | 204/288 |
| 1,750,807 | A | * | 3/1930 | Lichtman | 204/297.1 |
| 2,514,923 | A | * | 7/1950 | Batina | 204/297.07 |
| 2,697,690 | A | * | 12/1954 | Beebe, Jr. | 204/297.09 |
| 2,858,265 | A | * | 10/1958 | Schneider | 204/297.09 |
| 3,182,009 | A | * | 5/1965 | Nalband et al. | 204/212 |
| 3,259,563 | A | * | 7/1966 | Del Monica | 204/297.09 |
| 3,484,361 | A | * | 12/1969 | Sperry | 204/297.06 |
| 3,923,631 | A | * | 12/1975 | Palisin, Jr. | 204/297.06 |
| 3,939,056 | A | | 2/1976 | Fueki et al. | |
| 3,972,785 | A | * | 8/1976 | Palisin, Jr. | 204/297.1 |
| 4,037,727 | A | * | 7/1977 | Kunkle | 211/117 |
| 4,097,359 | A | * | 6/1978 | Davitz | 204/297.06 |
| 4,192,253 | A | | 3/1980 | Aichert et al. | |
| 4,217,853 | A | * | 8/1980 | Davitz | 118/500 |
| 4,233,937 | A | | 11/1980 | Steube | |
| 4,243,146 | A | * | 1/1981 | Davitz | 211/118 |
| 4,297,197 | A | | 10/1981 | Salman | |
| 4,746,416 | A | * | 5/1988 | Jacob | 204/297.04 |
| 4,752,371 | A | * | 6/1988 | Kreisel et al. | 204/297.1 |
| 4,872,963 | A | * | 10/1989 | Van Horn | 204/297.09 |
| 4,933,061 | A | * | 6/1990 | Kulkarni et al. | 204/224 R |
| 4,936,565 | A | * | 6/1990 | Fredrickson | 211/59.1 |

(Continued)

*Primary Examiner* — Jennifer E Novosad
(74) *Attorney, Agent, or Firm* — Schwegman Lundberg & Woessner, P.A.

(57) ABSTRACT

Some embodiments relate to a rack for coating components. The rack includes a horizontal top bar and a horizontal bottom bar. A first side bar electrically connects the horizontal top bar with the horizontal bottom bar and a second side bar electrically connects the horizontal top bar with the horizontal bottom bar. The horizontal bottom bar and the horizontal top bar are configured to be connected to the components, and the horizontal bottom bar is configured to be electrically connected to the components.

13 Claims, 14 Drawing Sheets

(56) References Cited

U.S. PATENT DOCUMENTS

| | | | | |
|---|---|---|---|---|
| 5,020,677 | A * | 6/1991 | Wirth et al. | 211/113 |
| 5,147,050 | A | 9/1992 | Cullen et al. | |
| 5,524,774 | A * | 6/1996 | Cullen | 211/113 |
| 5,531,334 | A * | 7/1996 | Forby | 211/119 |
| 5,607,069 | A * | 3/1997 | Stroobants et al. | 211/113 |
| 5,757,606 | A | 5/1998 | Westerberg | |
| 5,762,205 | A * | 6/1998 | Davitz | 211/13.1 |
| 5,788,829 | A * | 8/1998 | Joshi et al. | 205/96 |
| 6,189,709 | B1 | 2/2001 | Cullen | |
| 6,342,138 | B1 * | 1/2002 | Brown | 204/297.09 |
| 6,491,755 | B1 | 12/2002 | Meinke | |
| 6,530,489 | B1 * | 3/2003 | Van Horn et al. | 211/113 |
| 6,571,968 | B1 | 6/2003 | Cullen | |
| 6,673,215 | B2 * | 1/2004 | DeWent | 204/164 |
| 6,887,363 | B2 | 5/2005 | Andreae et al. | |
| 6,932,862 | B2 | 8/2005 | Daugherty | |
| 6,953,889 | B2 | 10/2005 | Hanks | |
| 7,021,476 | B2 * | 4/2006 | Lloyd et al. | 211/113 |
| 7,052,740 | B2 | 5/2006 | McNulty | |
| 7,290,320 | B2 | 11/2007 | Blankenship | |
| 8,136,475 | B2 | 3/2012 | Davis et al. | |
| 8,215,502 | B1 * | 7/2012 | Beavers | 211/119 |
| 8,220,523 | B2 | 7/2012 | Morgott et al. | |
| 2007/0160771 | A1 | 7/2007 | Sarajian | |
| 2010/0224315 | A1 | 9/2010 | Movsesian | |
| 2010/0282283 | A1 | 11/2010 | Bauer | |
| 2012/0055564 | A1 | 3/2012 | Gravisse et al. | |
| 2012/0222957 | A1 | 9/2012 | Wu et al. | |

* cited by examiner

RACK FOR COATING COMPONENTS

TECHNICAL FIELD

Embodiments pertain to a rack, and more particularly to a rack for coating components.

BACKGROUND

Many conventional coating systems use dedicated racks to hold components as they are subjected to various coating processes. These dedicated racks usually include numerous different types of fixtures that are used to hang the components on the rack.

One of the drawbacks with these types of fixture is that they are typically component-specific making them costly, inflexible and a challenge to store. In addition, such fixtures are difficult to maintain due to continuous cleaning that is required due to the repeated coating of the fixtures.

One common application for such racks is using the racks to electrocoat the components while they are on the rack. One of drawbacks with using such racks in electrocoating applications is that it is difficult to ensure that the components are electrically grounded. Electrical grounding of the components is required in order to adequately electrocoat the components.

Another drawback with using such racks in electrocoating applications where the components are dipped into a liquid-filled tank is that since the parts are merely hanging from such racks, the buoyancy of the liquid will often cause the components to come off the racks. When the components are forced from the rack by the liquid, the detached components can obstruct the overall operation of the system.

Another drawback with using conventional dedicated racks is that they can be relatively inefficient when it comes to maximizing the number of components that can be coated per cycle. In addition, the weight of such dedicated racks reduces the number of components that can be added to the rack before the rack reaches a designed weight limit.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

FIGS. 1-4 illustrate a rack 10 for coating components C. The rack 10 includes a horizontal top bar 11 and a horizontal bottom bar 12. A first side bar 13A electrically connects the horizontal top bar 11 with the horizontal bottom bar 12 and a second side bar 13B electrically connects the horizontal top bar 11 with the horizontal bottom bar 12.

The horizontal bottom bar 11 and the horizontal top bar 12 are configured to be connected to the components C, and the horizontal bottom bar 12 is configured to be electrically connected to the components C. It should be noted that the components C may (i) be all different shapes; (ii) include some common shapes; or (iii) be the same shape. The shapes and sizes of the components C will depend in part on the application where the components C are to be used.

Figure 1:
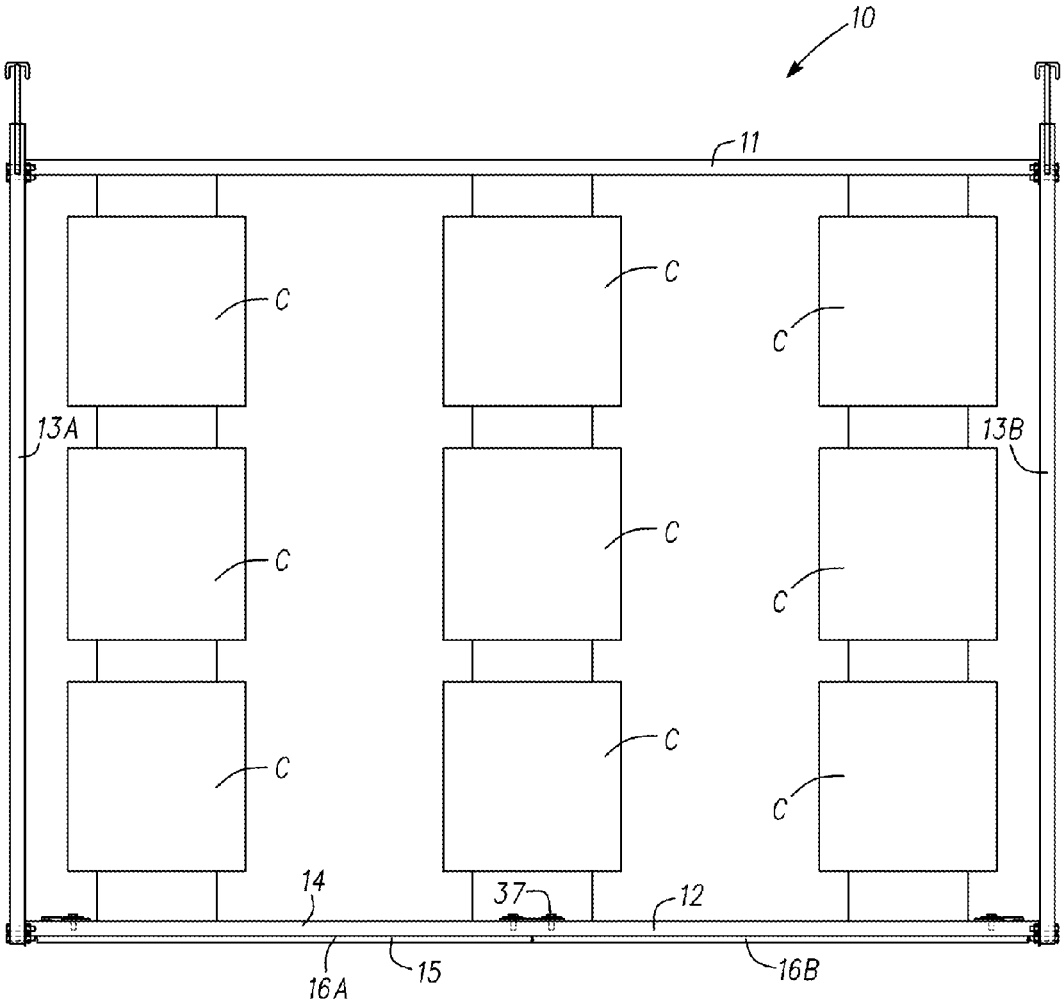
FIG. 1 is a front view of an example rack for coating components.
Figure 2:
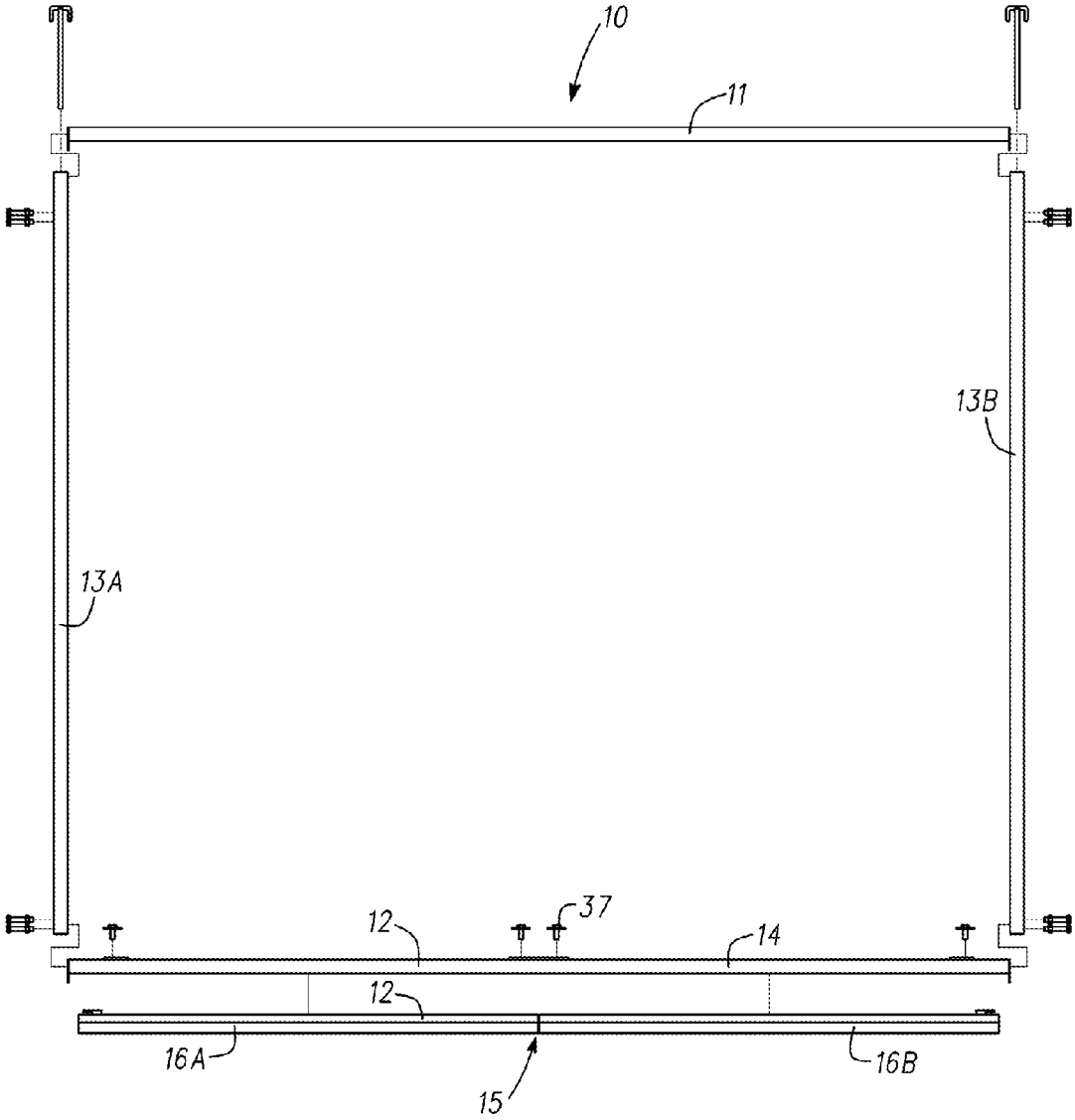
FIG. 2 is an exploded front view of the example rack shown in FIG. 1.
Figure 3:
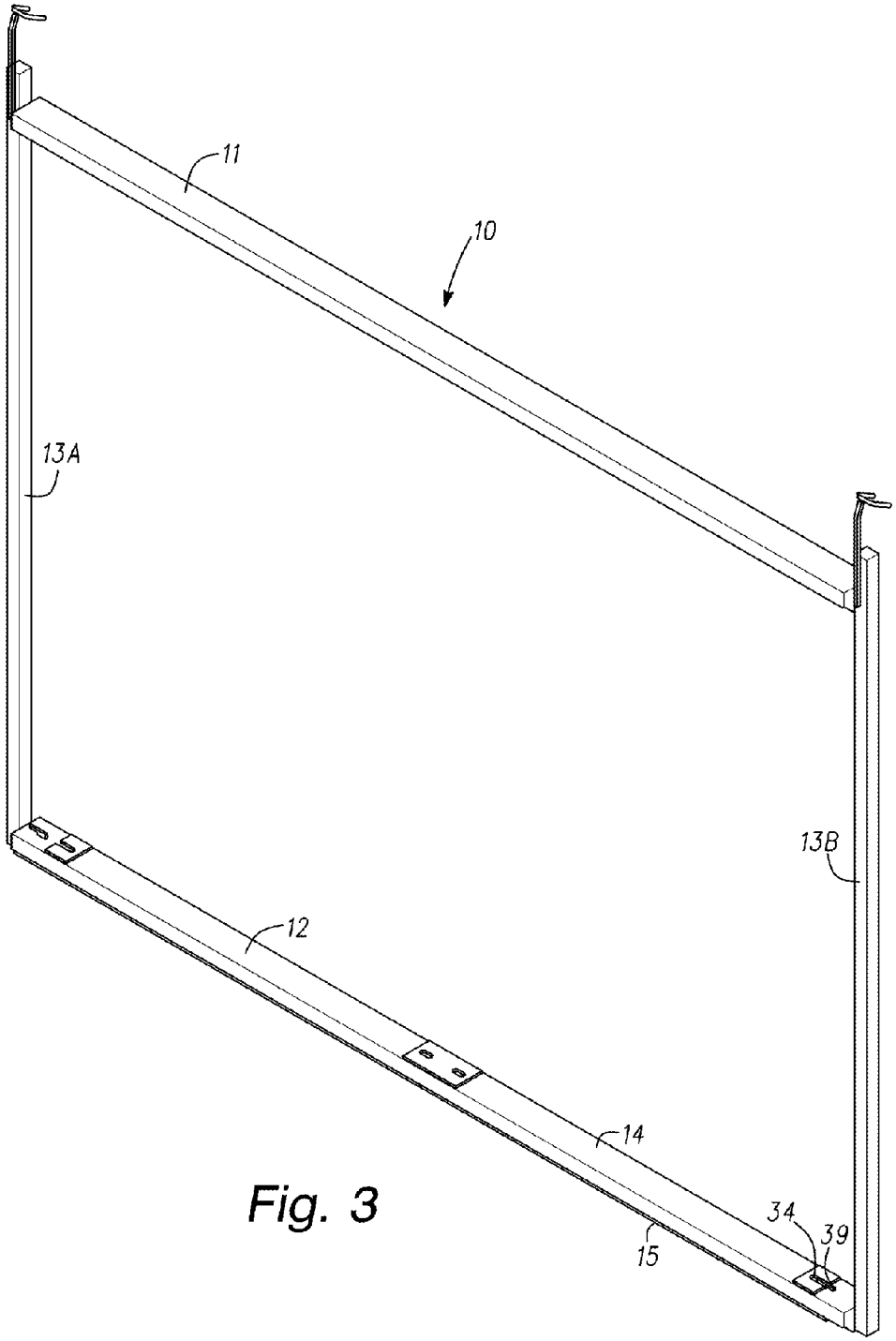
FIG. 3 is a perspective view of the example rack shown in FIG. 1.
Figure 4:
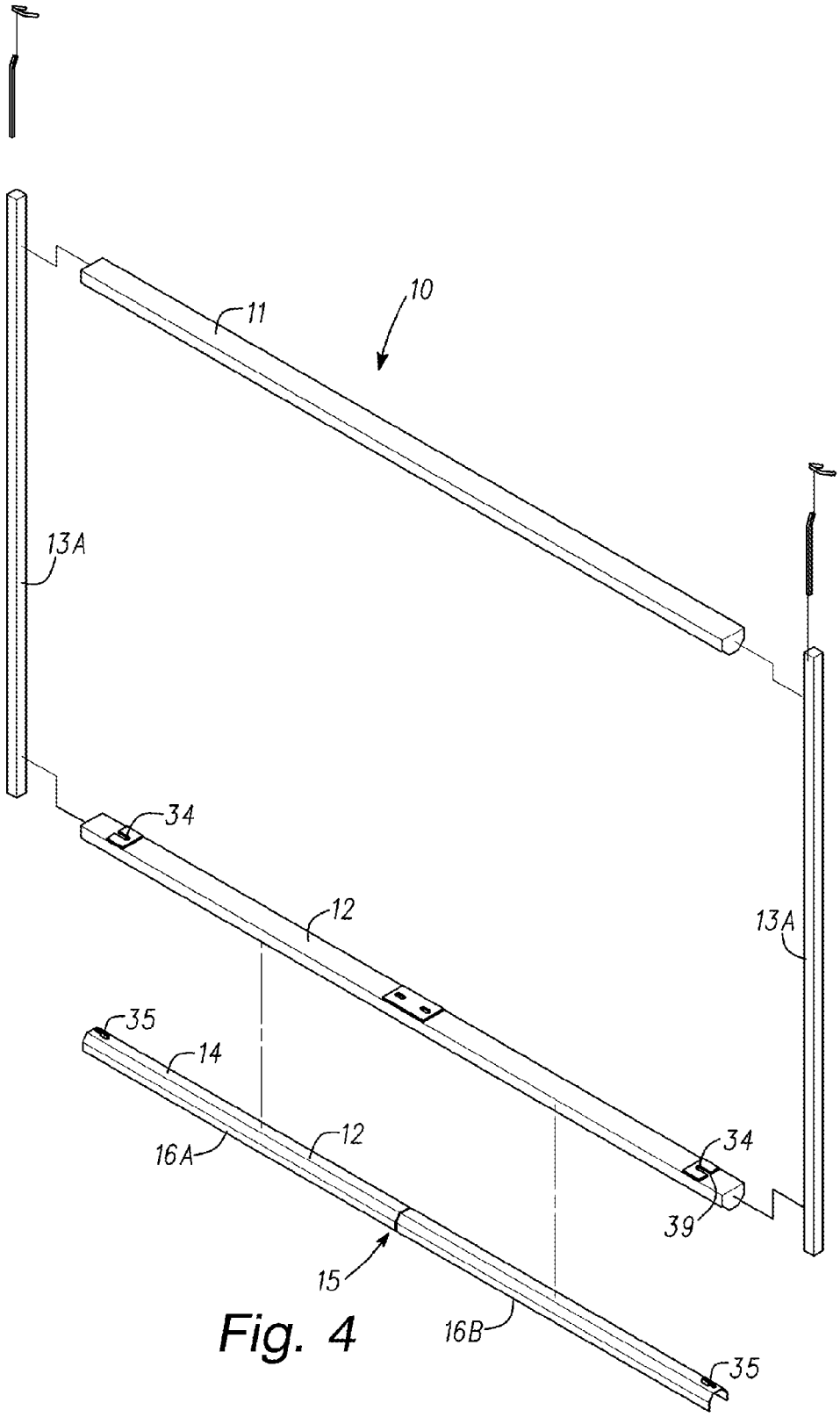
FIG. 4 is an exploded perspective view of the example rack shown in FIG. 3.
Figure 5:
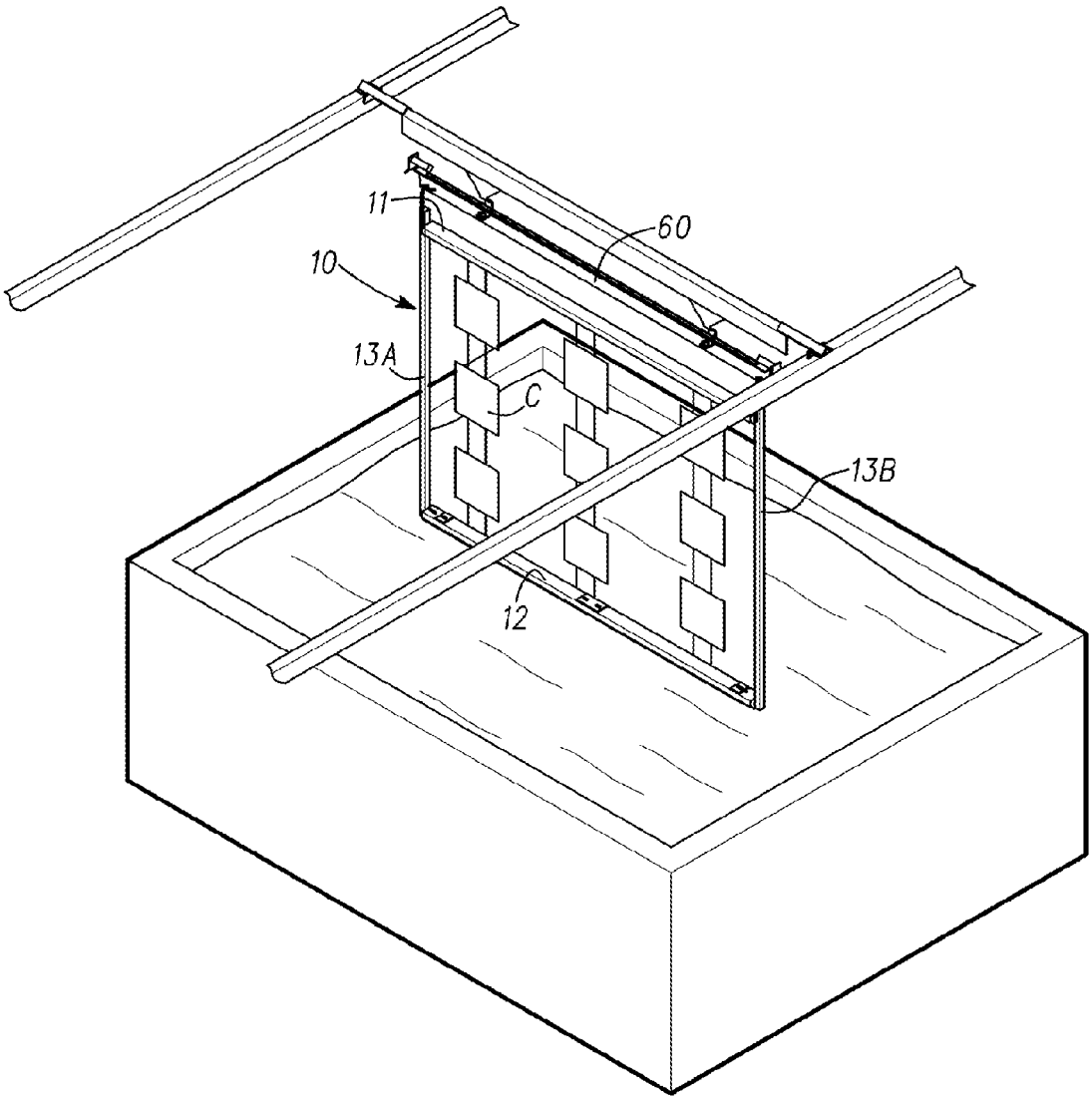
FIG. 5 is a perspective view of the rack shown in FIG. 1 where the rack is positioned above a tank where the components on the rack are to be electrocoated.
Figure 6:
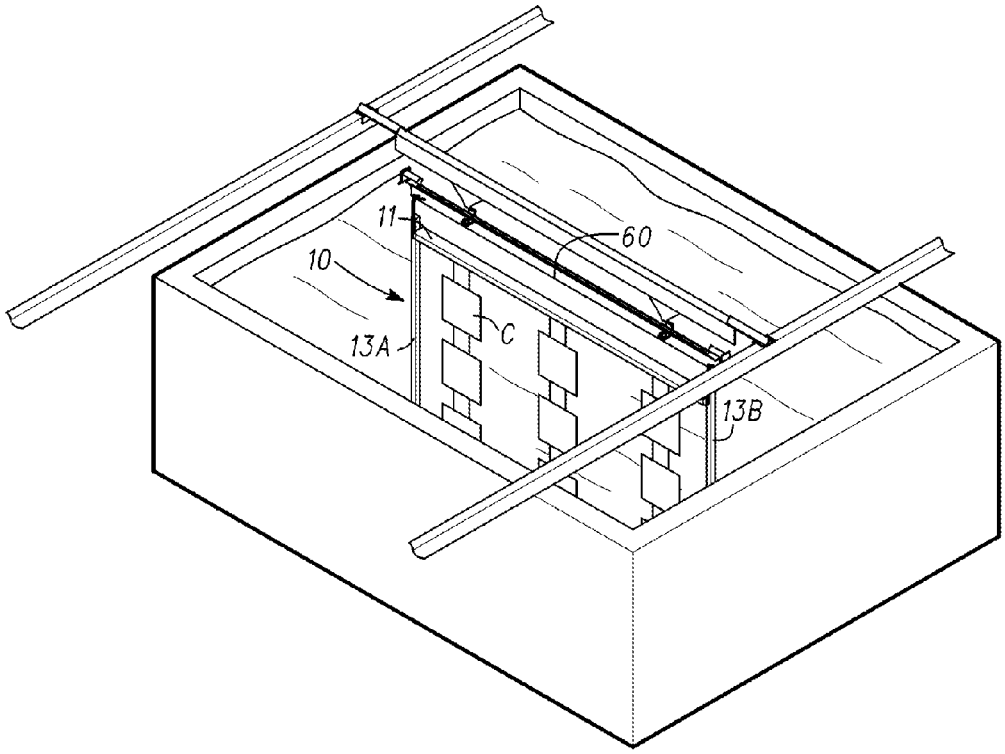
FIG. 6 is a perspective view similar to FIG. 5 where the rack is lowered in to tank so the components on the rack can be electrocoated.

FIG. 5 is a perspective view of the rack shown in FIG. 1 where the rack is positioned above a tank where the components on the rack are to be electronically coated. FIG. 6 is a perspective view similar to FIG. 5 where the rack is lowered in to tank so the components on the rack can be electrocoated.

As used herein, electrocoating refers to a process by which a metallic component is submerged in a paint/water bath and electricity is used to deposit paint onto the component. As an example, electrocoating may be an efficient method for applying corrosion inhibiting materials to a metallic component.

In the illustrated example embodiments, the horizontal top bar 11 and the horizontal bottom bar 12 are linear. It should be noted that embodiments are contemplated where the horizontal top bar 11 and the horizontal bottom bar 12 are non-linear (e.g., curved, wavy, zig-zag, etc.).

In the illustrated example embodiments, the first side bar 13A and the second side bar 13B are linear. It should be noted that embodiments are contemplated where the first side bar 13A and the second side bar 13B are non-linear (e.g., curved, wavy, zig-zag, etc.). In addition, although the first side bar 13A and the second side bar 13B are shown as being vertical, embodiments are contemplated where the first side bar 13A and the second side bar 13B are not vertical.

In the illustrated example embodiments, the first side bar 13A, the second side bar 13B, the horizontal top bar 11 and the horizontal bottom bar 12 are connected together in a rectangular shape (i.e., a window shape) such that the components C are within the rectangular shape as the components C are transported from one location to another. It should be noted that embodiments are contemplated where the first side bar 13A, the second side bar 13B, the horizontal top bar 11 and the horizontal bottom bar 12 are connected together in a closed non-rectangular shape (e.g., square, parallelogram, pentagon, etc.).

In some embodiments, the horizontal bottom bar 12 includes a structural member 14 (see FIGS. 7 and 8) that connects the first side bar 13A with the second side bar 13B. The horizontal bottom bar 12 further includes a grounding insert 15 (see FIGS. 9-15) that is detachably connected to the structural member 14 and electrically connected to the first and second side bars 13A, 13B.

In the illustrated example embodiments, the grounding insert 15 includes a first portion 16A that is electrically connected to the first side bar 13A and a second portion 16B that is electrically connected to the second side bar 13B. It should be noted that in other embodiments the grounding insert 15 may be a single piece that is electrically connected to the first and second side bars 13A, 13B.

Figure 7:
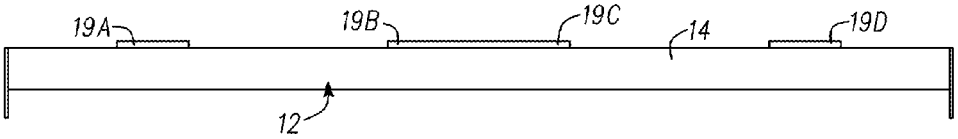
FIG. 7 is a front view of an example structural member that is used in the rack shown in FIG. 1.
Figure 8:
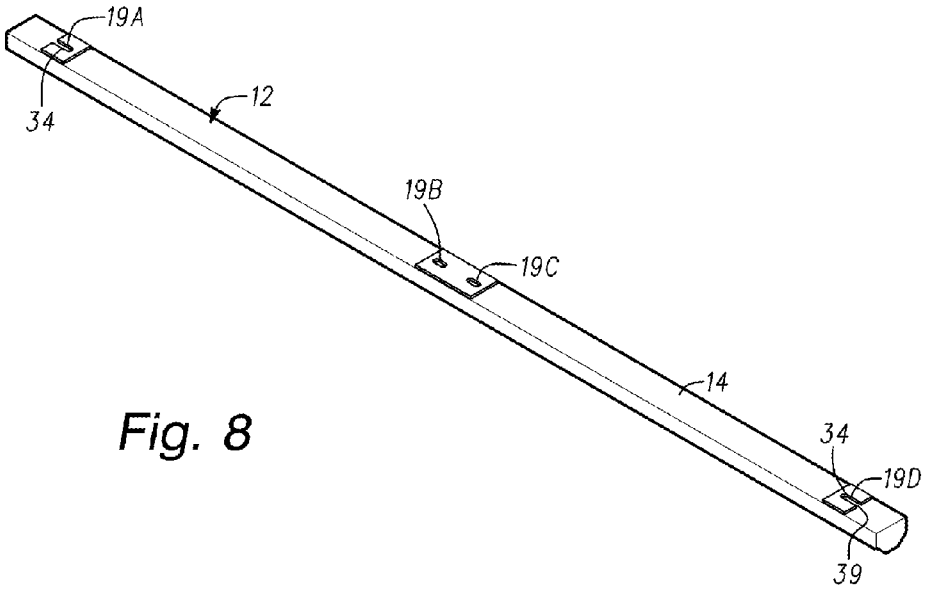
FIG. 8 is a perspective view of the example structural member that is used in the rack shown in FIG. 1.
Figure 9:
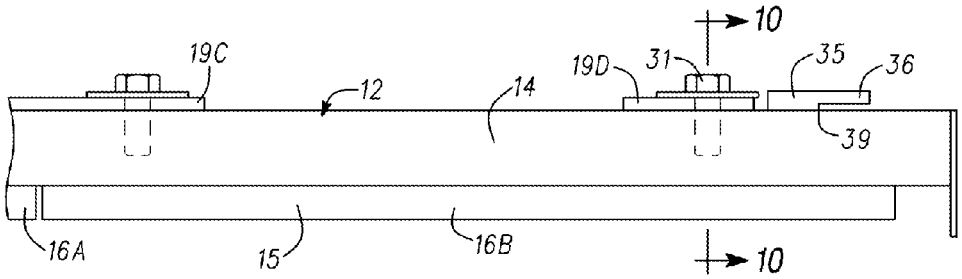
FIG. 9 is an enlarged front view of the example horizontal bottom bar shown in FIG. 7 where a first portion of a grounding insert is fastened to a structural member.

In some embodiments, the first portion 16A of the grounding insert may be fastened to the structural member 14 and the second portion 16B of the grounding insert may be fastened to the structural member 14. FIGS. 7-8 show where the first portion 16A is fastened to the structural member 14 at two locations 19A, 19B and the second portion 16B is fastened to the structural member 14 at two locations 19C, 19D.

Figure 10:
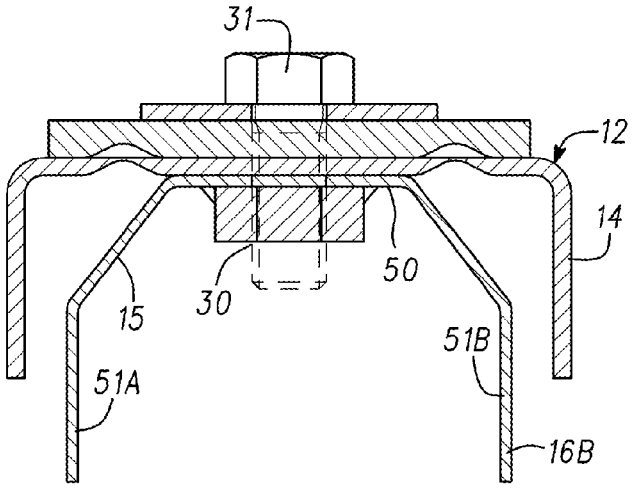
FIG. 10 is a section view of the horizontal bottom bar shown in FIG. 9 taken along line 10-10.
Figure 11:
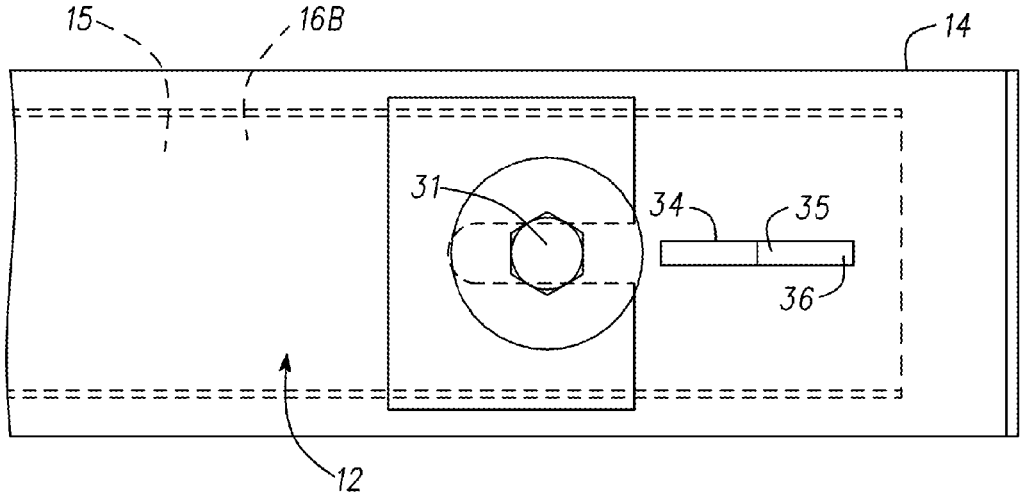
FIG. 11 is a top view of the horizontal bottom bar shown in FIG. 10.
Figure 12:
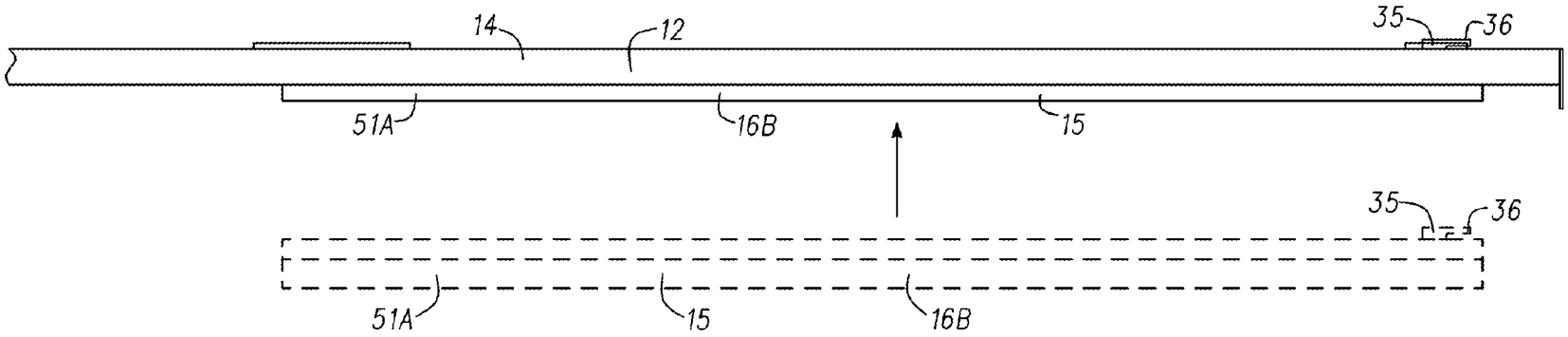
FIG. 12 is a front view of the horizontal bottom bar shown in FIG. 9 where a grounding insert is inserted in to the structural member.
Figure 15:
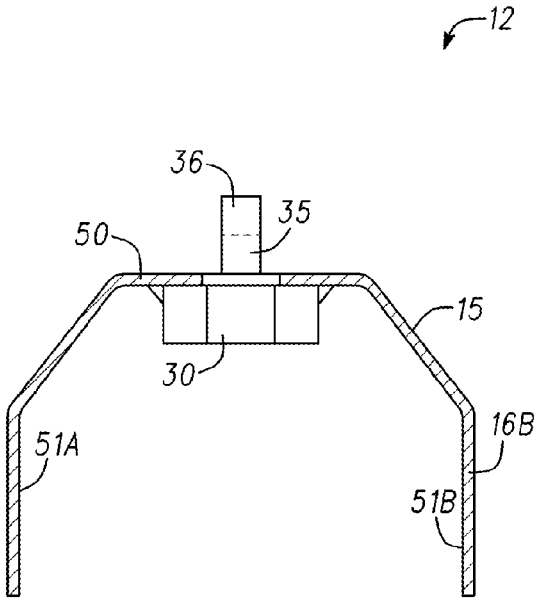
FIG. 15 is a section view of the second portion of the grounding insert shown in FIG. 14 taken along line 15-15.

As shown in FIGS. 10 and 15, the second portion 16B of the grounding insert 15 includes a threaded opening 30 such that a fastener 31 extends through the structural member 14 into the threaded opening 30 in order to secure the second portion 16B of the grounding insert 15 to the structural member 14. In the illustrated example embodiments, the structural member 14 includes a slot 34 (see FIG. 11) and the second portion 16B of the grounding insert 15 includes a tab 35 such that the second portion 16B of the grounding insert 15 is aligned relative to the structural member 14 when the tab 35 is inserted through the slot 34 (see FIG. 12). It should be noted that the other embodiments are contemplated where the slot 34 on the structural member 14 and the tab 35 on the grounding insert 15 are different sizes, shapes and orientations as long as that the first and second portions 16A, 16B of the grounding insert 15 are aligned relative to the structural member 14 when the respective tabs 35 are inserted through the respective slots 34.

Figure 13:
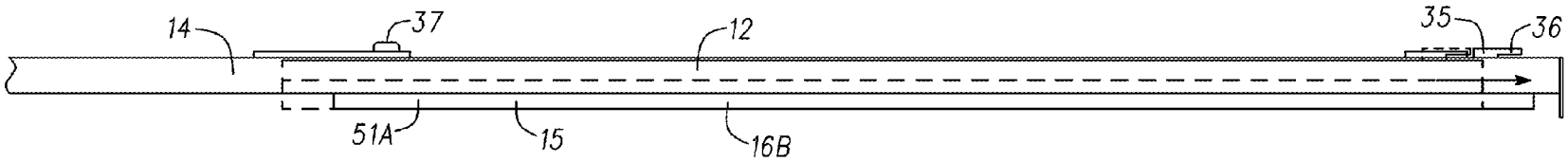
FIG. 13 is a front view similar to FIG. 12 of the horizontal bottom bar in FIG. 9 where the grounding insert is moved relative to the structural member.
Figure 14:
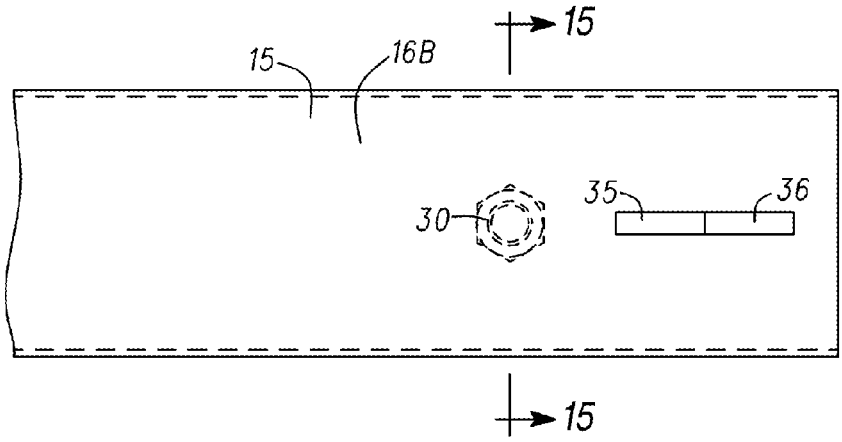
FIG. 14 is a top view of the second portion of the grounding insert shown in FIG. 9.

As an example, the tab 35 may include a projection 36 that supports the grounding insert 15 as the fastener 31 is inserted into the threaded opening 30 (see FIG. 13). Therefore, the projection 36 is able to provide support to one end of the second portion 16B of the grounding insert 15 while the other end is held place by hand so another fastener 37 (see FIGS. 1 and 2) can be inserted through the structural member 14 into another threaded opening in the second portion 16B of the grounding insert 15 in order to initially secure the second portion 16B of the grounding insert 15 to the structural member 14. It should be noted that the threaded opening 30 in the second portion 16B of the grounding insert 15 may be aligned relative to the structural member 14 when the tab 35 engages an end 39 (see FIGS. 3, 4, 8, 9, 13 and 18) of the slot 34 (see FIG. 11).

In the illustrated example embodiments, the structural member 14 is formed as a channel such that the grounding insert 15 is within the channel when the grounding insert 15 is fastened to the structural member 14. It should be noted that in other embodiments the structural member 14 and/or the grounding insert 15 may be other sizes and shapes. As shown most clearly in FIG. 15, the grounding insert 15 may include a horizontal section 50 that extends between a first side section 51A and a second side section 51B.

Figure 16:
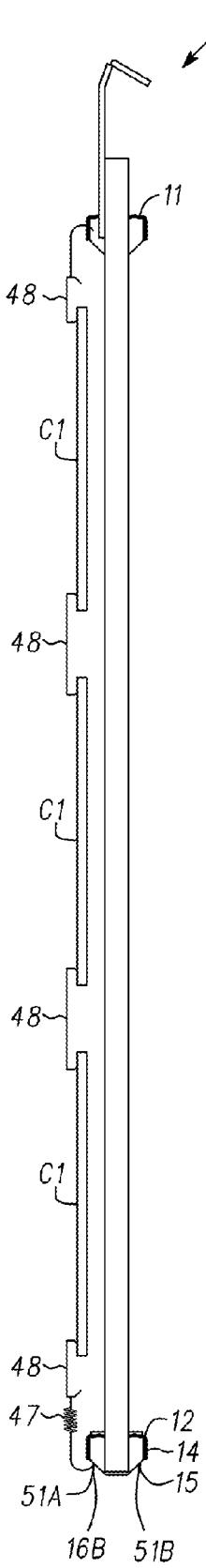
FIG. 16 is a side view of the example rack shown in FIG. 1 where the rack is used to electrocoat only a first set of components.

FIG. 16 is a side view of the example rack 10 shown in FIG. 1 where the example rack is used to transport only a first set of components C1. The first set of components C1 is secured to the first side section 51A or the second side section 51B of the grounding insert 15.

Figure 17:
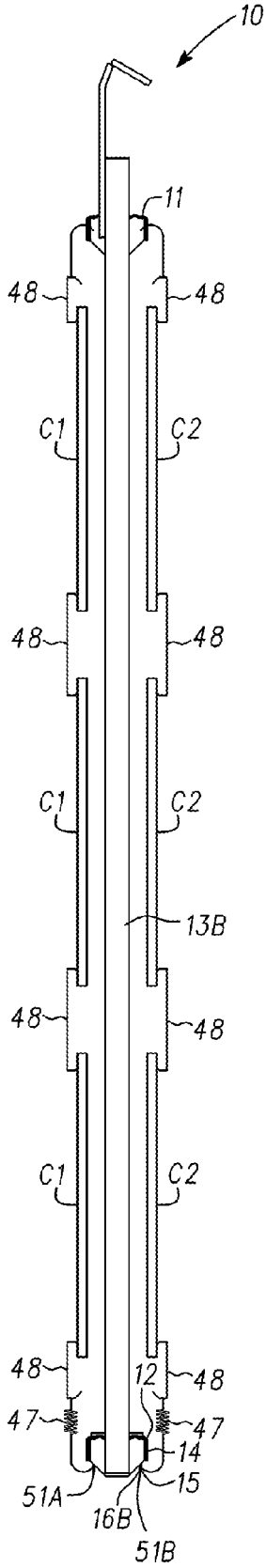
FIG. 17 is a side view of the of the example rack shown in FIG. 16 where the example rack is used to electrocoat a first set and a second set of components.

FIG. 17 is a side view of the example rack 10 shown in FIG. 15 where the example rack 10 is used to transport a first set of components C1 and a second set of components C2. The first set of components C1 is secured to the first side section 51A of the grounding insert 15 and a second set of components C2 is secured to the second side section 51B of the grounding insert 15.

The ability of the rack 10 to handle a first set of components C1 and a second set of components C2 may allow the example rack 10 to increase the overall number of components that are electrocoated. By increasing the overall number of components that are electrocoated, the example rack 10 may improve the efficiency and/or throughput of the associated electrocoating process where the example rack 10 is being utilized.

Figure 18:
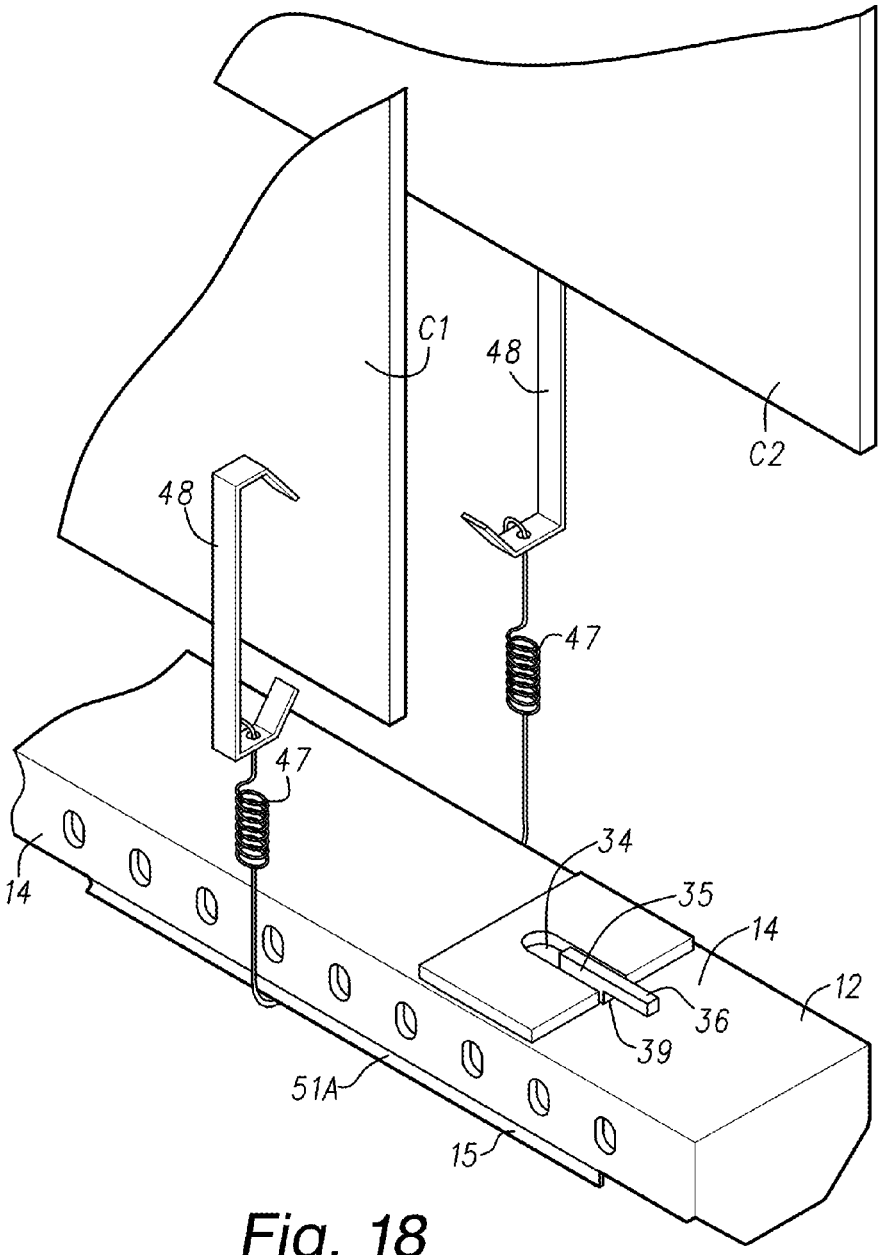
FIG. 18 is an enlarged perspective view illustrating a bottom portion the example rack shown in FIG. 1.

FIG. 18 is an enlarged perspective view illustrating a bottom portion of the rack 10 shown in FIG. 1. In the example embodiment that is illustrated in FIG. 18, the example rack 10 includes one or more springs 47 that secures one or more of the components C1, C2 to the horizontal bottom bar 12 such that the spring 47 electrically connects the components C to the horizontal bottom bar 12 (i.e., the grounding insert 15). In addition, the example rack 10 may further include a hook 48 that is attached between the component(s) C and the spring 47 such that the hook 48 electrically connects the components C to the spring 47.

The spring 47 and/or the spring 47 and hook 48 combination may allow the example rack 10 to securely hold the components C to the top horizontal bar 11 and the bottom horizontal bar 12 as the components C are electrocoated. The spring 47 provides a holding force and compensates for changing component tolerances for those components C that are secured using the spring 47. It should be noted that since the components C are secured between the top horizontal bar 11 and the bottom horizontal bar 12, the components C may be well-suited (i.e., aligned and/or oriented) to permit a variety of other manufacturing processes to be performed on the components C when the components C are secured to the example rack 10.

In addition, the spring 47 and hook 48 combination allows for a variety of different types of components C to be secured between the top horizontal bar 11 and the bottom horizontal bar 12. Therefore, the example rack 10 may provide flexibility in electronically coating different components C and different sets of components C. FIG. 1 shows an example embodiment where only hooks 48 are used to secure components C.

In some embodiments the hooks 48 and springs 47 may be cleaned between uses to provide a bare metal contact surface that promotes electrical connectivity with the components. In addition, although FIG. 18 shows the use of strap-type hooks in the illustrated embodiment, it should be noted that other types of hooks may be utilized (e.g., wire hooks of varying length, diameter and/or tension).

Figure 19:
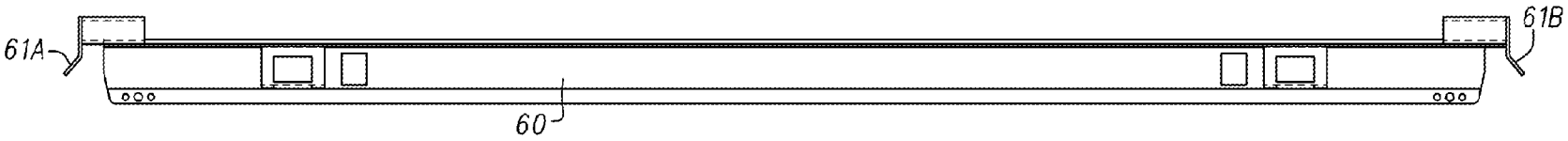
FIG. 19 is a front view of an example load member that may be used in the rack shown in FIG. 1.
Figure 20:
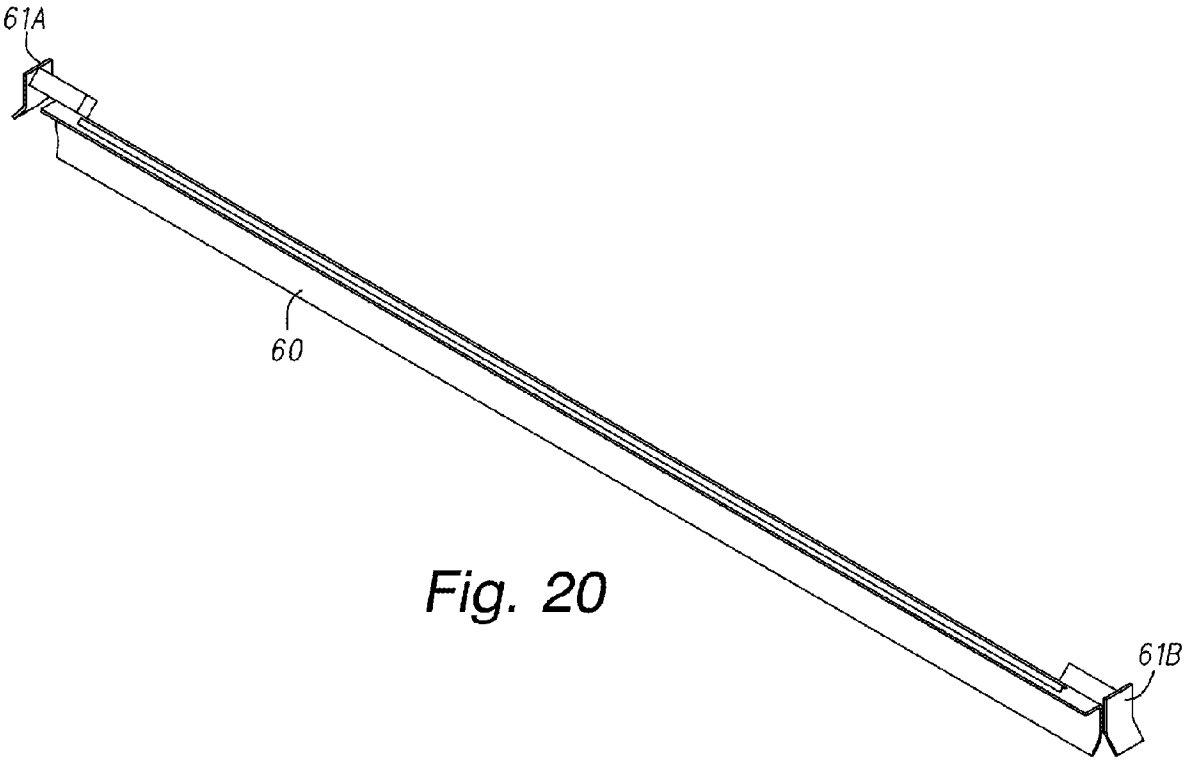
FIG. 20 is perspective view of the example load member shown in FIG. 19.
Figure 21:
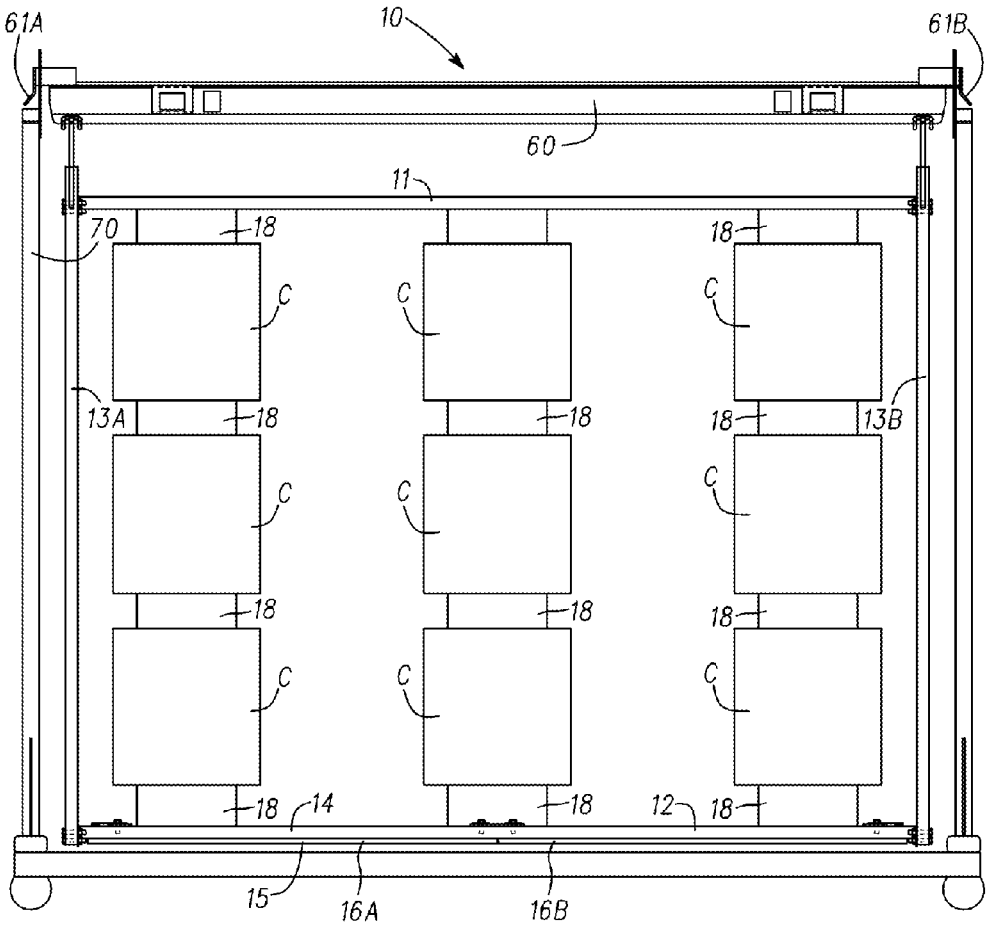
FIG. 21 is a front view of the rack shown in FIG. 1 mounted onto a carrier.

As shown most clearly in FIGS. 19-21, the example rack 10 may further include a load member 60 that is attached to (i) the horizontal top member 11; and/or (ii) the first and second side members 13A, 13B such that the load member 60 is positioned above the horizontal top member 11.

In the illustrated example embodiments, the horizontal top member 11, the horizontal bottom member 12 and the first and second side members 13A, 13B hang from the load member 60. In addition, the load member 60 may include a first support member 61A at one end of the load member 60 and a second support member 61B at an opposing end of the load member 60.

FIG. 21 shows an example embodiment where the first and second support members 61A, 61B of the load member 60 are configured to be received by (and possibly aligned with) a carrier 70. It should be noted that the type of carrier 70 that is configured to be receive the load member 60 will depend in part on (i) the overall size and weight of the components C; (ii) the distance that the components C need to travel in order to be electrocoated; and (iii) any manufacturing processes that the components C will be subjected to after they are electrocoated (e.g., painting).

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A rack for coating components comprising:

a horizontal top bar;

a horizontal bottom bar;

a first side bar electrically connecting the horizontal top bar with the horizontal bottom bar;

a second side bar electrically connecting the horizontal top bar with the horizontal bottom bar; and wherein the horizontal bottom bar is configured to be electrically connected to a bottom portion of a component at the same time an upper portion of the component is connected to the horizontal top bar, wherein the horizontal bottom bar includes a structural member that connects the first side bar with the second side bar, and a grounding insert that is detachably connected to the structural member and electrically connected to the first and second side bars, wherein the structural member is formed as a channel such that the grounding insert is within the channel when the grounding insert is fastened to the structural member.

2. The rack of claim 1, wherein the horizontal top bar and the horizontal bottom bar are linear.

3. The rack of claim 1, wherein the first side bar and the second side bar are linear.

4. The rack of claim 3, wherein the first side bar and the second side bar are vertical.

5. The rack of claim 3, wherein first side bar, the second side bar, the horizontal top bar and the horizontal bottom bar are connected together in a rectangular shape.

6. The rack of claim 1, wherein the components are adapted to be secured to the grounding insert.

7. The rack of claim 6, wherein the grounding insert includes a horizontal section that extends between a first side section and a second side section, and wherein a first set of components is adapted to be secured to the first side section and a second set of components is adapted to be secured to the second side section.

8. The rack of claim 1, further comprising a spring that is adapted to secure the components to the horizontal bottom bar such that the spring electrically connects the components to the horizontal bottom bar.

9. The rack of claim 8, further comprising a hook that is adapted to be attached between the components and the spring such that the hook electrically connects the components to the spring.

10. A rack for coating components comprising:

a horizontal top bar;

a horizontal bottom bar;

a first side bar electrically connecting the horizontal top bar with the horizontal bottom bar;

a second side bar electrically connecting the horizontal top bar with the horizontal bottom bar; and wherein the horizontal bottom bar is configured to be electrically connected to the components, wherein the horizontal bottom bar includes a structural member that connects the first side bar with the second side bar, and a grounding insert that is detachably connected to the structural member and electrically connected to the first and second side bars, wherein the grounding insert includes a first portion that is electrically connected to the first side bar and a second portion that is electrically connected to the second side bar, wherein the first portion of the grounding insert is fastened to the structural member and the second portion of the grounding insert is fastened to the structural member, wherein the first portion of the grounding insert includes a threaded opening such that a fastener extends through the structural member to be secured by the threaded opening and fasten the first portion of the grounding insert to the structural member, wherein the structural member includes a slot and the first portion of the grounding insert includes a tab such that the first portion of the grounding insert is aligned relative to the structural member when the tab is inserted through the slot.

11. The rack of claim 10, wherein the tab includes a projection that supports the grounding insert as the fastener is inserted into the threaded opening.

12. The rack of claim 11, wherein the threaded opening is aligned relative to the structural member when the tab engages an end of the slot.

13. A rack for coating components comprising:

a horizontal top bar;

a horizontal bottom bar;

a first side bar electrically connecting the horizontal top bar with the horizontal bottom bar;

a second side bar electrically connecting the horizontal top bar with the horizontal bottom bar;

wherein the horizontal bottom bar is configured to be electrically connected to the components; and a load member that is attached to at least one of the horizontal top member and the first and second side members such that load member is positioned above the horizontal top member, wherein the horizontal top member, the horizontal bottom member and the first and second side members hang from the load member and are electrically connected to the load member, wherein the load member includes a first vertical support member at one end of the load member and a second vertical support member at an opposing end of the load member, wherein the first vertical support member is configured to be received by a first portion of a carrier and the second vertical support member is configured to be received by a second portion of the carrier, wherein the first and second vertical support members align the load member relative to the carrier.

* * * * *